United States Patent [19]

Suckle

[11] Patent Number: 4,566,117

[45] Date of Patent: Jan. 21, 1986

[54] SPEECH SYNTHESIS SYSTEM

[75] Inventor: Leonard I. Suckle, Scottsdale, Ariz.

[73] Assignee: Motorola, Inc., Schaumburg, Ill.

[21] Appl. No.: 432,466

[22] Filed: Oct. 4, 1982

[51] Int. Cl.[4] ..... G10L 1/00
[52] U.S. Cl. ..... 381/51
[58] Field of Search ..... 381/51–53; 364/513, 513.5

[56] References Cited

U.S. PATENT DOCUMENTS

| | | | |
|---|---|---|---|
| 3,102,165 | 8/1963 | Clapper | 381/51 |
| 3,830,977 | 8/1974 | Dechaux | 381/51 |
| 4,163,120 | 7/1979 | Baumwolspiner | 381/51 |

OTHER PUBLICATIONS

Flanagan, J., Speech Analysis, Synthesis, Perception, Springer-Verlag, N.Y., 1972, pp. 344, 370.

*Primary Examiner*—E. S. Matt Kemeny
*Attorney, Agent, or Firm*—Joe E. Barbee

[57] ABSTRACT

A speech synthesis system uses a programmable digital divider to generate desired formant frequencies. The divide factor is controlled by an MPU. The output of the divider is passed through a sinewave shaper and then through an electronically controlled amplitude amplifier to provide an audio output. The system is based upon the realization that alternating between two formant frequencies at the pitch rate generates a sound comparable to generating two formants simultaneously and adding algebraically.

5 Claims, 2 Drawing Figures

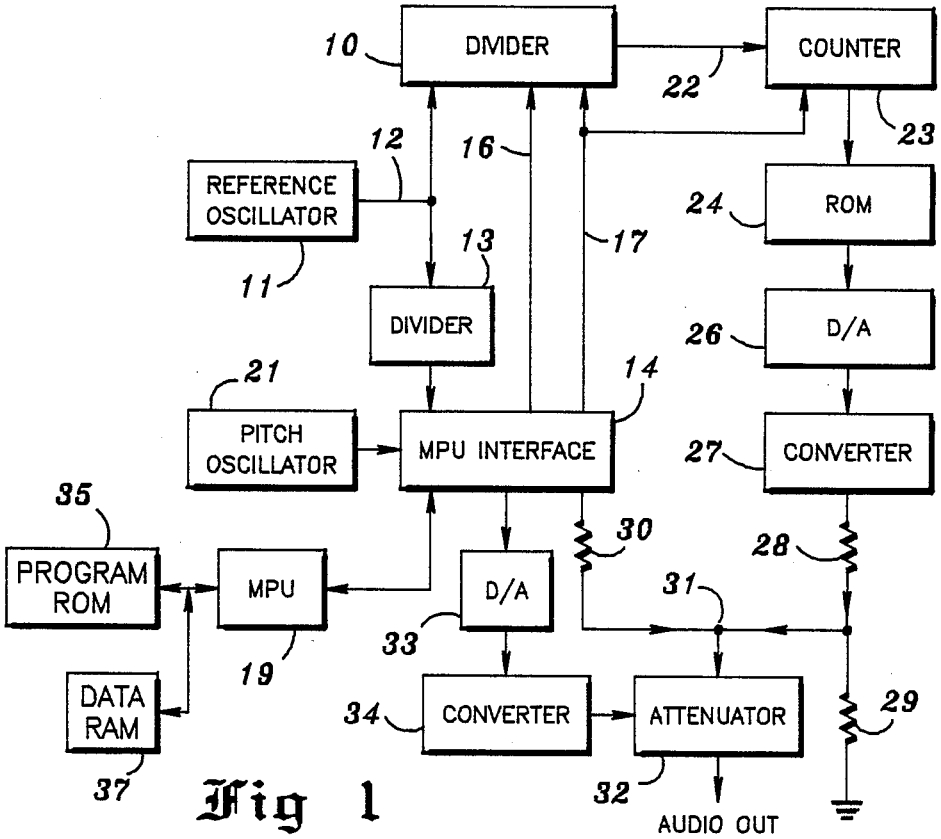
Fig 1
Fig 2
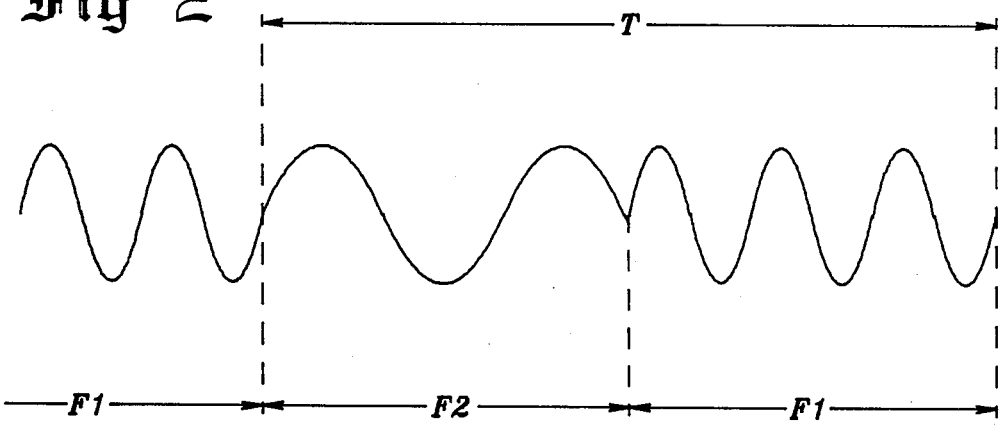

SPEECH SYNTHESIS SYSTEM

BACKGROUND OF THE INVENTION

This invention relates, in general, to speech synthesis systems, and more particularly, to a speech synthesis system which can be easily controlled by a microprocessor.

Voiced speech is physically generated by creating, with the vocal cords, an impulse repeated at the pitch frequency, and filtering the signal in the mouth and nose cavity. In a frequency domain, the vocal chords generate bursts of energy at harmonics of the pitch frequency. The filtering of the mouth and nose cavity attenuates various harmonics to result in certain vocal sounds as the accentuated harmonic frequencies. In the past, three main techniques have been used to synthesize human speech. They are formant synthesis, linear predictive coding (LPC), and wave form digitization with compression. With these techniques, vocal utterances or phonemes have been linked by linguistic rules to generate words. Formant synthesis is a technique for modeling the natural resonances of the vocal tract. With this technique voiced sounds are generated from an impulse source that is modulated in amplitude to control intensity. The resulting signal is passed through two levels of filtering wherein the first is a time variant filter to provide the source spectrum and mouth radiation characteristics of the speech waveform. Unvoiced sounds generated as white noise are passed through a variable pole-zero filter.

Linear predictive coding is somewhat similar to formant synthesis since both are based in the frequency domain and use similar hardware. The basic difference is that LPC uses previous conditions to determine present filter coefficients and the quality of the synthesis improves as the number of coefficients is increased. Waveform digitization is the oldest approach taken for speech synthesis and relies on nothing more than sampling of the waveform in the time domain at twice the highest frequency of interest. Normally, data compression is used for this technique to avoid prohibitive memory requirements. These prior art systems tended to use large amounts of hardware and required considerable software.

Accordingly, it is an object of the present invention to provide an improved speech synthesis system and method of generating intelligible humanistic speech by generating voice sounds of speech by utilizing a waveform which alternates between primary formants of the sound at the pitch frequency.

Another object of the present invention is to generate actual formant frequencies by a microprocessor (MPU) based system in a more efficient manner.

SUMMARY OF THE INVENTION

The above and other objects and advantages of the present invention are provided by digitally dividing a reference oscillator's output frequency to obtain a desired frequency. The divide factor is controlled by an MPU. The output divide frequency is passed through a sinewave shaper to obtain the particular formant sinewave. A method of generating speech is provided which comprises alternating between two formant frequencies at the pitch rate to generate the speech. This voiced signal is added by a signal adder to unvoiced sound and the sum of the two signals is then passed through an amplitude amplifier which shapes the sounds into distinctive phonemes.

BRIEF DESCRIPTION OF THE DRAWINGS

FIG. 1 is a block diagram of one embodiment of the present invention; and

FIG. 2 contains a waveform useful in understanding the present invention.

DETAILED DESCRIPTION OF THE DRAWINGS

The present invention results from the recognition that energy only exists at harmonics of the pitch frequency when sourced by the vocal chords (although wide band continuous spectrum energy can exist due to the "hissing" of the mouth system) and that the filter response curve for a particular phoneme for a specific speaker appears to be fixed, independent of the pitch frequency. As a result of these two observations, any voiced phoneme, within a limited pitch range, can be produced by added fixed integer multiples of the pitch frequency formants. As an example, "Ah" may be generated by adding a 700 Hz and a 900 Hz sinewave at 100 Hz pitch. In other words, the sinewaves that are added are seven times and nine times the pitch frequency. It was observed that the algebraic addition of two phase locked formant waveforms results in a waveform very similar in appearance to one physically produced. The amplitude of the formants, can be decayed and restarted at the pitch frequency thus introducing the pitch frequency as modulation of the summation waveform. It was also observed that the frequency domain representation of the voiced phoneme is not too different than that of an FM signal. In its simplest form, a frequency spectrum is generated comparable to the desired spectrum by alternating between the formant frequencies at the pitch rate. A reasonable sounding phoneme is generated when the formant frequencies are harmonics of the pitch frequency.

FIG. 1 illustrates in block diagram form a speech synthesis system capable of carrying out the present invention. The system illustrated in FIG. 1 can be simplified as will be noted hereinafter. A programmable divider 10 receives an input clock signal via line 12 from a reference oscillator 11. Reference oscillator 11 also provides an input to a timing signal divider 13 via line 12. The output of timing signal divider 13 is coupled to an MPU interface unit 14 and is used to synchronize the various signals generated in the system. MPU interface unit 14 serves as an interface between MPU 19 and the remainder of the speech synthesis system. A program read-only memory (ROM) 35 and a data random access memory (RAM) 37 are also connected to MPU 19. A pitch oscillator 21 is also coupled to MPU interface unit 14 and is used to control the pitch or inflection of the synthesized speech. MPU interface 14 provides a multi-bit data output on line 16 to program the value of programmable divider 10. The output of divider 10 is connected by line 22 to the clock input of a counter 23. MPU interface 14 also provides a reset output on line 17 to divider 10 and to counter 23. The output provided by divider 10 is a square wave at thirty-two times the desired frequency. Counter 23 sequentially provides thirty-two digital addresses to a read only memory (ROM) 24 which, as a result, outputs multi-bit digital amplitude data for a thirty-two part sinewave. It was determined that thirty-two gives a satisfactory resolution although it will be noted that this multiple could be higher or lower than thirty-two. The output from ROM 24 is connected to a digital-to-analog converter 26. If the output of digital converter 26 is a current instead of a voltage it must be passed through a current-to-voltage converter 27. The output of current-to-voltage converter 27 is a sinewave equal in frequency to one of the desired formant frequencies of the voiced speech. This voiced audio output is added to unvoiced audio generated in the MPU by software and output from MPU interface unit 14. Resistors 28 and 29 are connected in series from the output of converter 27 to ground. A resistor 30 is used to couple the unvoiced audio from MPU interface unit 14 to node 31. Resistors 28, 29, and 30 serve as a summing network to sum the voiced audio from converter 27 and the unvoiced audio from MPU interface unit 14. Node 31 is connected to the audio input of an electronic attenuator 32. MPU interface unit 14 provides a multi-bit output to a digital-to-analog converter 33 whose output is converted from a current to voltage by converter 34. The output of converter 34 is applied to the amplitude control input of electronic attenuator 32.

In the implementation illustrated, two formant frequencies were chosen to create voiced sound, although a greater number of formant frequencies may be utilized for higher quality but with greater complexity. The pitch frequency is that frequency which a listener perceives as the pitch or inflection of speech. In this implementation, pitch cycle is generated by switching between the two selected formant frequencies such that both frequencies are sequentially selected during a period of time equal to one cycle of the pitch frequency. This is shown in FIG. 2, where T is the period of the pitch frequency, and F1 and F2 are the two formant frequencies during time T.

Pitch oscillator 21 is applied to an edge sensitive input circuit of MPU interface 14 in FIG. 1, so oscillator 21 must run at twice the desired pitch frequency to complete the two-frequency cycle at the desired rate. Pitch oscillator 21 can be a fixed external oscillator for monotone speech or a voltage controlled oscillator could be used to programmatically control the pitch and inflection. It is also possible to use an MPU software timing loop to provide the pitch frequency.

Reference oscillator 11 provides a high frequency signal which is divided down by divider 10 to derive the individual formant frequencies. The speech synthesis system illustrated in FIG. 1 provides formant frequencies from 200 Hz to 2000 Hz, which will be in 100 Hz intervals for a pitch frequency of 100 Hz (typical for a human male). Since division may be performed only by integer values, a sufficiently high-frequency reference oscillator is used to provide accurate formant intervals. Reference oscillator 11 generates approximately 400 KHz or $2^{12}$ times a 100 Hz pitch frequency. In additiaon to providing the formant reference, oscillator 11 is also divided down by divider 13 to a lower fixed frequency to provide a fixed period for basic timing of the generated phonemes.

Programmable divider 10 is programmed to select the appropriate formant frequency. The appropriate divide factor is output on one port of interface unit 14. The system as illustrated provides an output frequency from divider 10 which is thirty-two times the actual formant frequency. For a minimum frequency requirement of 200 Hz, the divider output frequency must be 32 times 200 Hz or 6.4 KHz. Divider 10 must therefore provide a minimum of six bits of divide since 100 times $2^{12}$ divided by 6400 equals 64 or $2^6$.

A sine wave shaper is provided by counter 23, ROM 24, digital-to-analog converter 26, and I/V converter 27. A reasonably distortion free sinewave is critical to produce humanistic intelligible speech. Square and triangular wave forms are unnatural sounding to the ear and should be avoided. A satisfactory sinewave is generated by storing normalized values of a thirty-two part sinewave in ROM 24. The address lines of ROM 24 are driven from outputs of counter 23 which is clocked by the output of programmable divider 10. Data word stored in ROM 24 is output to digital-to-analog converter 26 where it is mildly filtered. The output of converter 27 represents the actual formant signal. The thirty-two parts which are stored in ROM 24 thus require a clock frequency thirty-two times the desired output frequency. As stated hereinbefore, the thirty-two part sinewave could be increased or decreased, depending upon the desired clarity. The illustrated system uses a ROM which is eight bits (or one byte) wide, however, all eight bits of data may be excessive to describe each value of the sinewave, and the number of bits stored could possibly be reduced.

Resistors 28, 29, and 30 serve as a signal adder which permit the voice sinewave formant signal and the unvoiced turbulence to share a common input to electronic attenuator 32.

The speech synthesis system illustrated in FIG. 1 uses a DC volume control arrangement provided by digital-to-analog converter 33, I/V converter 34, and attenuator 32; however, it will be noted that any comparable arrangement could be used. The amplitude control signal from interface unit 14 is output as an eight bit word into digital-to-analog converter 33 which is coupled by converter 34 to the control input of electronic attenuator 32. The response time of this amplitude control circuitry should be fast enough to select the appropriate amplitude for each formant time duration, which, as a maximum, should be two times the maximum pitch frequency, e.g. 600 Hz which is twice the pitch frequency for a child. With a basic period equal to 1.6 milliseconds, the amplitude response should probably approach 2 to 3 KHz.

By way of example only, the elements of FIG. 1 can be supplied with readily available components from Motorola, Inc. having the following Motorola part numbers. Divider 10 could be two 8-bit programmable dividers MC14526. Divider 13 could be an MC14020, MPU interface unit 14 could be an MC6821, MPU 19 could be a 6800 microprocessor unit, counter 23 could be 5-bit MC14040 counter, ROM 24 could be a 1K×8 ROM MCM68708, digital-to-analog converter 26 could be an MC1408, converter 27 could be an operational amplifier such as an MC3403, attenuator 32 could be an MC3340, digital-to-analog converter 33 could be an MC1408, and converter 34 could be another operational amplifier such as MC3403.

Data describing each of the basic elements of speech to be generated is stored either in Program ROM 35, along with the operating code of MPU 19, or in RAM 37. This data is stored as a sequence of 8 bit words (bytes) and specifies various parameters controlling the desired formant frequencies, attack and decay times, amplitudes and other factors determining each of the sounds.

There are four general types of sequences, which may be called "data packets". These four types are (1)

voiced, (2) unvoiced, (3) space, and (4) end-of-string (EOS). Each of the four types of "data packets" contain different types of data and are of different lengths or number of bytes, as shown in the table below. The data packets are used by concatination to form the various phonemes of which speech is constructed.

DATA PACKET TABLE

| TYPE | NUMBER OF BYTES | DATA REPRESENTED BY BYTES |
|---|---|---|
| VOICED | 5 | Divide Factors #1, #2, Duration, Amplitudes, Attack Time |
| UNVOICED | 4 | Bandwidth Mask, Attack Time, Duration, Amplitude |
| SPACE | 3 | Space ID Character, Decay time (of previous data packet). Duration |
| EOS | 1 | End-of-String ID Character |

As each data packet is encountered the software will perform the appropriate sequence for the specified duration. At the end of the packet, the next packet will be read and the new sequence implemented. This procedure will continue until an End-Of-String character is detected, which is used to reset and restart the string.

An example of typical operation would be as follows:

1. The MPU initializes the interface unit and counters.

2. The first data packet is read which is assumed to be a voiced packet. (The packet parameters are stored in a memory, such as the random access memory.)

3. The first divide factor, D1 is output to the programmable divider 10, while a duration register in the MPU is initialized. The amplitude associated with this divide factor is noted and if the packet indicates, an instantaneous amplitude change is output to the amplitude control. If an attack rate is specified, the final amplitude is stored for comparison, and the previous amplitude is left unchanged for the meantime.

4. The pitch oscillator input is continuously polled and when a signal change is detected the second divide factor and associated amplitude are output. The next pitch oscillator transition will cause the first divide factor to again be output and this alternating signal will continue until stopped.

5. The externally derived timing signal is polled and is used to decrement the duration register. When the duration count expires, the next data packet is read. Also, the output amplitude will be increased at the packet-specified rate until the maximum amplitude specified is attained.

6. An unvoiced packet operates similarly except the output is keyed on and off at a random rate as designated by an internal random number generator.

7. A space packet either instantaneously reduces the output amplitude to zero or gradually reduces it at the packet-specified rate. Thus, if a gradually increasing and then decreasing voice signal were desired, a voiced packet with attack would be followed by a space packet with decay.

FIG. 2 illustrates by waveform the voiced implementation of the present invention. The time period T is the pitch frequency and the signal illustrated shows two frequencies, F1 and F2, used to generate a specific sound. For example, if the pitch frequency (1/T) is 100 Hz, and F1 and F2 are 700 Hz and 900 Hz, respectively, the sound "AH" could be generated.

By now it should be appreciated that there has been provided an improved voice synthesis system wherein voice sounds can be created by individually but sequentially generating specific amplitudes of pitch frequency harmonics (formants). Alternating the dominant formant frequencies at the pitch frequency results in voice sounds comparable to that in human speech. An MPU based system is used to generate the actual formant frequencies. This differs from most prior formant systems which use an impulse pitch oscillator to represent the glottis (or vocal chords) and thus to generate a series of harmonics. In addition, by alternating between two formant frequencies at the pitch rate to generate a sound comparable to generating two formants simultaneously and adding algebraically, the system hardware and software can be simplified by being required to generate only one frequency at a time. The amplitude of each generated frequency can easily be controlled with a single amplitude control stage. Unvoiced or fricative sounds are generated by a software random number sequence which is bounded to provide band shaped noise. Software can be used to generate a multitude of attack and decay rates for amplitude control required for the speech envelope.

Microprocessor 19 along with interface unit 14, ROM 35, and RAM 37 serve as a microcomputer. Some microcomputers contain a digital-to-analog converter as well as a clock source. By using such a microcomputer, digital-to-analog converter 33, converter 34, and pitch oscillator 21 could be eliminated since all these functions could be performed by the microcomputer. Counter 23, ROM 24, digital-to-analog converter 26 along with converter 27 form a sine wave shaper. Digital-to-analog converter 33, current-to-voltage converter 34, along with attenuator 32 form an electronically controlled amplitude amplifier.

An alternate embodiment of the present invention would be to use a microprocessor unit to provide a software selectable clock output and connect this clock output directly into counter 23 which would eliminate dividers 10 and 13 along with reference oscillator 11.

Yet another embodiment of the present invention would be to, within the microprocessor, create by software the digital amplitude values of a sinewave. This data would be presented at output 16 and connected directly to digital-to-analog converter 26. This would eliminate the need for counter 23, divider 13, ROM 24, divider 10, and reference oscillator 11, provided that an internal MPU clock is used.

I claim:

1. A method of generating elements of speech comprising: providing a short duration of a first formant frequency; providing a short duration of a second formant frequency; and alternating between the first and second formant frequencies at a pitch frequency rate.

2. The method of claim 1 including switching multiple formant frequencies at a rate to repeat at the pitch frequency.

3. The method of claim 2 including using a microprocessor to control a programmable frequency divider to derive the desired formant frequencies.

4. The method of claim 2 including using a microcomputer to generate the formant frequencies.

5. The method of claim 2 including using a microcomputer to generate unvoiced speech sounds to generate phonomes.

* * * * *